US006941706B2

(12) United States Patent
Austin et al.

(10) Patent No.: US 6,941,706 B2
(45) Date of Patent: Sep. 13, 2005

(54) VENTED EAVES CLOSURE

(75) Inventors: Kevin Austin, Encinitas, CA (US); Jerry Vandewater, Thousand Oaks, CA (US)

(73) Assignee: Monier Lifetile LLC, Irvine, CA (US)

( * ) Notice: Subject to any disclaimer, the term of this patent is extended or adjusted under 35 U.S.C. 154(b) by 30 days.

(21) Appl. No.: 10/143,566

(22) Filed: May 10, 2002

(65) Prior Publication Data

US 2003/0005649 A1 Jan. 9, 2003

Related U.S. Application Data

(60) Provisional application No. 60/290,142, filed on May 10, 2001.

(51) Int. Cl.[7] ..... E04B 7/00
(52) U.S. Cl. ..... 52/94; 52/95; 52/97; 52/302.3
(58) Field of Search ..... 52/94, 95, 96, 52/97, 518, 302.3, 732, 302.1

(56) References Cited

U.S. PATENT DOCUMENTS

| | | | | |
|---|---|---|---|---|
| 1,585,897 A | | 5/1926 | Davidson | |
| 1,764,479 A | * | 6/1930 | Tobias | 52/543 |
| 2,885,942 A | | 5/1959 | Hirst | |
| 2,928,274 A | | 3/1960 | Berg | |
| 3,137,970 A | | 6/1964 | Tiernan | |
| 3,199,256 A | | 8/1965 | Considder | |
| 3,352,649 A | | 11/1967 | Tennison, Jr. | |
| 3,415,020 A | | 12/1968 | Windle | |
| 3,683,785 A | | 8/1972 | Grange | |
| 3,777,649 A | * | 12/1973 | Luckey | 454/260 |
| 3,922,824 A | | 12/1975 | Izawa et al. | |
| 3,950,900 A | | 4/1976 | Simpson | |
| 4,007,672 A | * | 2/1977 | Luckey | 454/260 |
| 4,096,671 A | * | 6/1978 | Aarons | 52/94 |
| 4,096,790 A | | 6/1978 | Curran | |
| 4,237,672 A | | 12/1980 | Peterson | |
| 4,418,505 A | * | 12/1983 | Thompson | 52/95 |
| 4,472,913 A | | 9/1984 | Hickman | |
| 4,577,442 A | | 3/1986 | Callaway | |
| 4,581,861 A | | 4/1986 | Eury | |
| 4,592,176 A | | 6/1986 | van Herpen | |
| 4,601,135 A | * | 7/1986 | Ellis et al. | 52/58 |

(Continued)

*Primary Examiner*—Brian E. Glessner
*Assistant Examiner*—Basil Katcheves
(74) *Attorney, Agent, or Firm*—Alston & Bird, LLP

(57) ABSTRACT

A method is provided for installing a ventilated eaves closure and tile support apparatus along the eaves of a roof. A vented eaves closure apparatus is disposed along the eaves to support the first course of roof tiles at a desired pitch. The apparatus provides support, ventilation, and drainage, while also providing a barrier to wind-driven precipitation, bird nesting, and animal invasion. The apparatus includes an array of openings configured to allow drainage and facilitate the flow of air beneath the tiles and throughout the air space between the roof deck and the tiles. The method and apparatus can be adapted to fit a variety of roof types and roof tiles having different sizes, shapes, and profiles.

17 Claims, 16 Drawing Sheets

U.S. PATENT DOCUMENTS 4,759,157 A 7/1988 Webb et al.
4,907,499 A 3/1990 James
4,967,521 A * 11/1990 Pike ..... 52/95
4,995,308 A 2/1991 Waggoner
5,060,431 A 10/1991 MacLeod et al.
5,092,086 A * 3/1992 Rognsvoog, Sr. ..... 52/12
5,092,225 A 3/1992 Sells
5,115,603 A 5/1992 Blair
5,274,974 A 1/1994 Haag
5,274,975 A 1/1994 Haag
5,328,406 A 7/1994 Morris, Jr. et al.
5,414,965 A 5/1995 Kelley et al.
5,427,571 A 6/1995 Sells
5,473,847 A * 12/1995 Crookston ..... 52/302.1
5,531,049 A 7/1996 Hirai et al.
5,596,847 A 1/1997 Stephenson
5,603,657 A 2/1997 Sells
5,636,481 A * 6/1997 De Zen ..... 52/95
5,765,329 A 6/1998 Huang
5,816,909 A * 10/1998 Wunder ..... 454/341
5,832,677 A * 11/1998 Kurttila ..... 52/95
5,881,501 A 3/1999 Guffey et al.
5,921,038 A 7/1999 Burroughs et al.
5,924,925 A 7/1999 Nystrom
5,941,028 A 8/1999 Hicks
6,079,166 A 6/2000 Mason et al.
6,088,971 A 7/2000 Nystrom
6,243,995 B1 * 6/2001 Reeves et al. ..... 52/94
6,286,273 B1 * 9/2001 Villela et al. ..... 52/199
6,325,712 B1 12/2001 Lawless, III et al.
6,401,412 B1 6/2002 Cooper
6,415,559 B1 * 7/2002 Reeves et al. ..... 52/94
6,598,353 B1 * 7/2003 Reeves ..... 52/57
2003/0051419 A1 * 3/2003 Suzuki ..... 52/90.1

* cited by examiner

VENTED EAVES CLOSURE

CROSS-REFERENCE TO RELATED APPLICATIONS

This application claims the benefit and priority of the pending Provisional Patent Application entitled, "Vented Eaves Closure," Application Ser. No. 60/290,142, filed May 10, 2001, which is incorporated herein by reference, together with any and all attachments and exhibits thereto.

FIELD OF THE INVENTION

The present invention relates generally to the field of roofing tile installation. More particularly, the invention provides a method for installing and supporting the lowermost or first course of roof tiles along the eaves and an apparatus for supporting the roof tiles at a desired pitch, allowing drainage, promoting ventilation, and preventing animal infiltration.

BACKGROUND OF THE INVENTION

The installation of a tile roof involves a variety of technical challenges and problems not encountered during the installation of a traditional shingle roof. Traditional shingles are relatively thin and can be placed almost flat onto the roof decking in overlapping rows. In contrast, roofing tiles tend to be thicker and more rigid, and do not tend to lie as flat when overlapping one another. Thus, roofing tiles require special consideration and handling, particularly when installing the first course along the eaves.

In addition to flat-shaped tiles, modern roof tiles are made in a variety of sizes and shapes to complement different architectural styles. For example, a traditional S-shaped tile might be used for Spanish-style architecture, while a W-shaped tile might be used for a Mediterranean-style project. The multitude of shapes available today increases the complexity of the technical challenges and problems encountered when installing a tile roof.

The installation of roof tiles typically begins with the step of laying a first row or course of tiles along the eaves of a roof. While the edges of the upper courses of tile will rest upon the next lowest course, the lowermost edge of the first course of tile has no tile upon which to rest. Thus, the lowermost edge of the first course of tiles must be elevated above the roof decking to the desired angle or pitch for proper installation.

Various methods and devices have been used for elevating the lowermost edge of the first course of tile, but some of these methods and devices can create new problems both during and after installation. Such problems include improper or inaccurate tile pitch, lack of universal fit among tiles of different shapes and sizes, unattractive appearance, poor drainage, poor ventilation, inadequate structural support, poor resistance to wind and weather, and increased vulnerability to bird nesting and animal infiltration.

Adequate drainage and ventilation is critical to the proper installation of a tile roof. Drainage is critical because the accumulation of water behind and under the tiles can lead to serious and expensive problems such as standing water, ice dams in cold climates, wood rot, roof leakage, and structural failure. Ventilation is critical to reduce heat transfer through the attic space and into the occupied living space. Also, a tile roof creates an air space between the tile and the roof deck which acts as a thermal barrier. Creating a flow of air through this air space can help dissipate accumulated heat.

Bird nesting and animal infiltration represent a significant problem for various tile shapes having what is known as a high profile. The curvature of a high-profile tile such as the traditional S-shaped Spanish tile creates a large space beneath the tile, making the eaves and roof vulnerable to bird nesting and animal infiltration. Similarly, the curvature of lower-profile tiles such as the W-shaped Mediterranean tiles also create open spaces along the eaves which require closure.

The prior art closure devices have been plagued by problems such as poor ventilation and interference with water shedding. One such prior art configuration requires the installation of a new, tall fascia board along the eaves to support the lowermost edge of the first course of tile. The fascia board creates a water dam at the edge of the roof, so a metal flashing must be installed to allow water to flow over the board.

Another field method involves the pouring of a strip of mortar along the eaves, with weep holes drilled or formed through it to allow water drainage. Another method in use involves the installation of metal eaves closure strips, with additional flashing and drilled weep holes for drainage, such as the one disclosed in U.S. Pat. No. 4,418,505 issued to Thompson on Dec. 6, 1983. Although weep holes allow some water to escape, they offer little or no ventilation of the roof. Although these field methods and devices may have their own advantages, they illustrate the need for systems that provide improved drainage and ventilation in addition to providing closure and accurate tile pitch.

Thus, there remains a need for a method and apparatus for elevating the first course of tile that will permit water to flow safely off the roof and promote adequate ventilation, while assuring proper tile elevation and support, and adequate resistance to animal and environmental infiltration. Such a method and apparatus should accomplish these goals in a reliable, durable, attractive, low-maintenance, and cost-effective manner.

SUMMARY OF THE INVENTION

The above and other needs are met by the present invention which provides a method and apparatus for installing and supporting a first course of roof tiles along the eaves of a roof while providing closure of the eaves and ventilation of the roof.

Generally described, the present invention provides an eaves closure system for a tile roof. The tile roof is characterized by a roof decking, an eaves, and a first course of roof tiles along the eaves. The eaves closure system includes a vented eaves closure having a base adjacent said eaves and a riser façade extending upwardly from said base and having sufficient height to support said first course at a desired pitch. The eaves closure system also includes an array of openings through said vented eaves closure configured to permit drainage and promote ventilation.

In one aspect, the top edge of the riser façade is sized and shaped to fill the space between the eaves and the bottom profile of the tiles. The top edge may include a rim disposed along its length.

In one embodiment the vented eaves closure also includes a rear riser extending from the top edge of said riser façade toward said base. The vented eaves closure may also include a skirt panel extending from said rear riser in a direction generally parallel to said base.

In one embodiment, the openings in the eaves closure system pass through said riser façade only. In another, the entire vented eaves closure is constructed of a rigid screen and the array of openings form a regular and repeating pattern throughout.

In another aspect, the invention provides an apparatus called a vented eaves closure for a first course of roof tiles along an eaves of a roof. The vented eaves closure includes a base adjacent said eaves, a riser façade extending upwardly from said base and having sufficient height to support said first course at a desired pitch, and an array of openings configured to permit drainage and promote ventilation.

In one aspect, the top edge of the riser façade is sized and shaped to fill the space between the eaves and the bottom profile of the tiles. The top edge may include a rim disposed along its length.

In one embodiment the vented eaves closure also includes a rear riser extending from the top edge of said riser façade toward said base. The vented eaves closure may also include a skirt panel extending from said rear riser in a direction generally parallel to said base.

In one embodiment, the openings in the eaves closure system pass through said riser façade only. In another, the entire vented eaves closure is constructed of a rigid screen and the array of openings form a regular and repeating pattern throughout.

In another aspect, the invention provides a method for ventilating and closing a tile roof. The method steps include providing a vented eaves closure having a base, a riser facçade, and an array of openings; attaching the base to said roof decking adjacent said eaves; and, laying said first course atop said vented eaves closure. The method may also include forming said vented eaves closure from a rigid screen having a regular and repeating pattern of openings.

In one embodiment, the method also includes the further step of selecting said vented eaves closure from a plurality of stock closures such that said riser façade is sized and shaped to fill a space defined by said eaves and said bottom profile.

In another embodiment, the method also includes the further step of shaping said riser façade until its size and shape will fill a space defined by said eaves and said bottom profile.

In another embodiment, the method also includes the further step of selecting said vented eaves closure from a plurality of stock closures, each having a blank riser façade. The next step in this embodiment includes shaping said blank riser façade until its size and shape will fill a space defined by said eaves and said bottom profile.

In another aspect, the invention provides a system for ventilating and closing a tile roof. The system includes a plurality of partially overlapping roof tiles, an eaves closure installed adjacent said eaves and having a base and a riser extending upwardly from said base to said bottom profile, a cavity defined by said roof decking, said roof tiles, said eaves closure, and said peak, and an array of openings through said eaves closure sized and shaped to promote a circulation of air within said cavity. The system may also include an air mover positioned to draw air through said cavity.

In another embodiment, the system may also include an array of vents through said roof decking positioned at intervals to promote a circulation of air beneath said cavity.

In another aspect, the invention provides a method of fabricating an eaves closure for a tile roof. The method includes the steps of selecting a sheet of material having sufficient strength to support said first course of roof tiles and sufficient ductility to withstand bending, treating said sheet to improve its resistance to corrosion in the expected use environment, cutting a portion from said sheet according to a pattern, said pattern sized and shaped to encompass said eaves closure, and bending one or more segments of said portion according to said pattern.

In one embodiment, the method may also include creating an array of openings through said sheet at one or more locations such that said eaves closure after fabrication will permit drainage and promote ventilation.

In another aspect of the invention, the eaves closure system may comprise two pieces, a vented eaves closure and a vented profiled filler, along with an array of openings. The vented eaves closure includes a base and a riser façade extending upwardly from said base to an upper edge. The vented profiled filler includes a tongue area configured to connect to said vented eaves closure and a profiled area sized and shaped to fill a space defined by said upper edge and said bottom profile.

In one embodiment, the vented eaves closure may also include a groove along said upper edge of the riser façade. The groove is sized and shaped to receive said tongue area of the profiled filler.

In another embodiment, the profiled area of the vented profiled filler may also include a rim disposed along a top edge of said profiled area.

In one embodiment, the openings in the eaves closure system pass through said riser façade only. In another, the entire vented eaves closure and/or the vented profiled filler is constructed of a rigid screen and the array of openings form a regular and repeating pattern throughout.

In another aspect, the present invention provides a method of providing ventilation and closure to a tile roof. The method steps include: providing a vented eaves closure having a base, a riser façade, and an array of openings; providing a vented profiled filler sized and shaped to fill a space defined by said upper edge and said bottom profile; attaching said base to said roof decking adjacent said eaves; connecting said vented profiled filler to said vented eaves closure; and laying said first course atop said vented eaves closure. The method may also includes the steps of providing a groove along said upper edge of the vented eaves closure and inserting the vented profiled filler into the groove.

In one embodiment, the method also includes shaping said vented profiled filler until its size and shape will fill a space defined by said upper edge and said bottom profile.

In another embodiment, the method may also include selecting said vented profiled filler from a plurality of stock fillers having a blank profile, and shaping said blank profile until the size and shape of said vented profiled filler will fill a space defined by said upper edge and said bottom profile.

It is a principal object of the present invention to provide a vented eaves closure apparatus to support the first course of roof tiles along the eaves of a roof at a desired pitch.

It is a further object of this invention to facilitate the circulation of air underneath the roof tiles and throughout the eaves, attic, and roof structure. It is a related object of this invention to minimize the heat transfer from the roof tiles, through the attic space, and into the living space.

It is another object of this invention to facilitate the shedding of water off the roof from underneath the roof tiles without any appreciable damming or ponding.

It is yet another object of the present invention to provide a vented eaves closure apparatus to prevent the infiltration of wind-driven precipitation.

It is another object of the present invention to provide a vented eaves closure apparatus to prevent bird nesting and other animal invasion through the eaves.

It is a further object of the present invention to provide a vented eaves closure apparatus to fit a variety of tiles having different sizes, shapes, and profiles.

These and other objects are accomplished by the method and apparatus disclosed and will become apparent from the following detailed description of a preferred embodiment in conjunction with the accompanying drawings in which like numerals designate like elements.

BRIEF DESCRIPTION OF THE DRAWING

FIG. 17 illustrates various items 29 used under an embodiment of an invention.

FIG. 18 illustrates various items 39 used under an embodiment of an invention.

DETAILED DESCRIPTION OF THE INVENTION

Reference is now made to the figures, in which like elements indicate like elements throughout the several views.

Preparation of a typical roof to receive roofing tiles usually involves the installation of a generally planar roof decking, a waterproof underlayment, and a series of battens at regular intervals to support the tiles. The lowermost edge of a sloped roof is called the eaves. The battens are typically installed in rows parallel to the eaves. The first row or course of roof tiles is installed along the eaves.

A roof tile is generally rectangular in plan view, having a thickness and a distinct shape in cross-section called a profile. The top and bottom surfaces need not be identical. The top surface can be seen from above and is often stylized for a desired appearance, whereas the bottom profile of a roof tile is typically hidden and may contain specific contours and features not apparent after installation.

Figure 14:
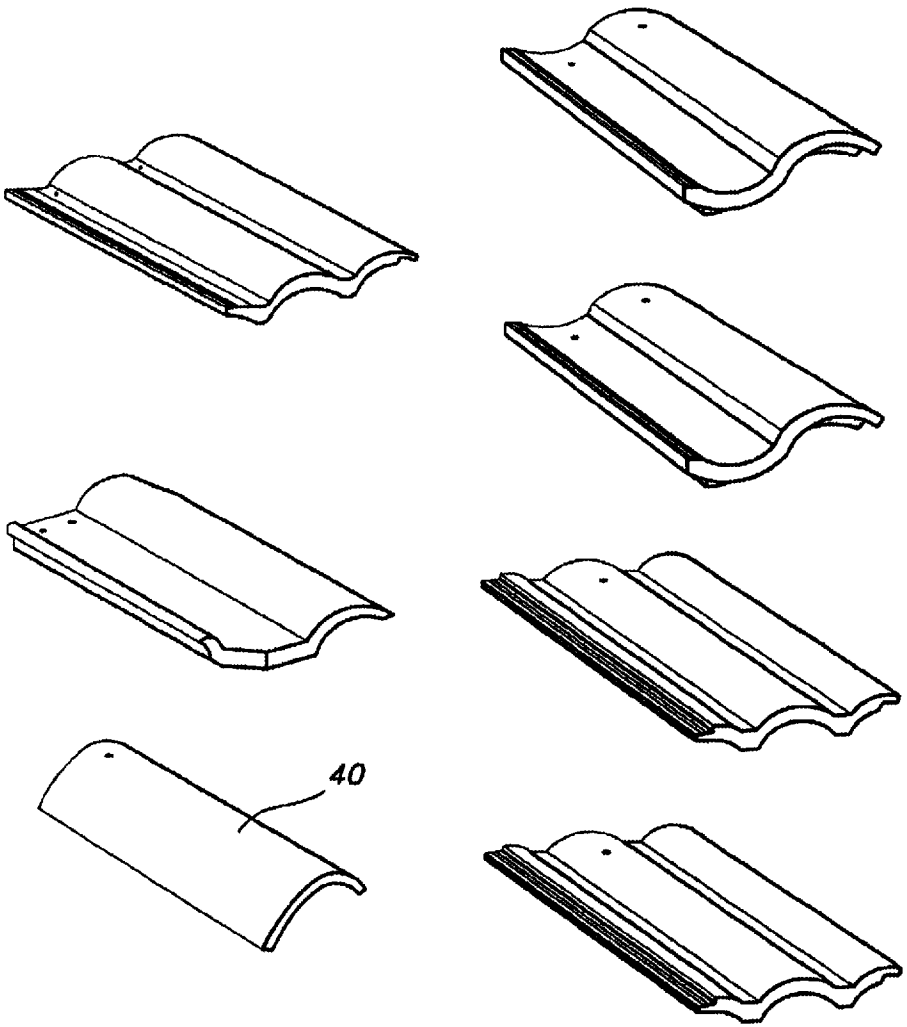
FIG. 14 is a perspective view of a variety of high-profile roof tiles.
Figure 15:
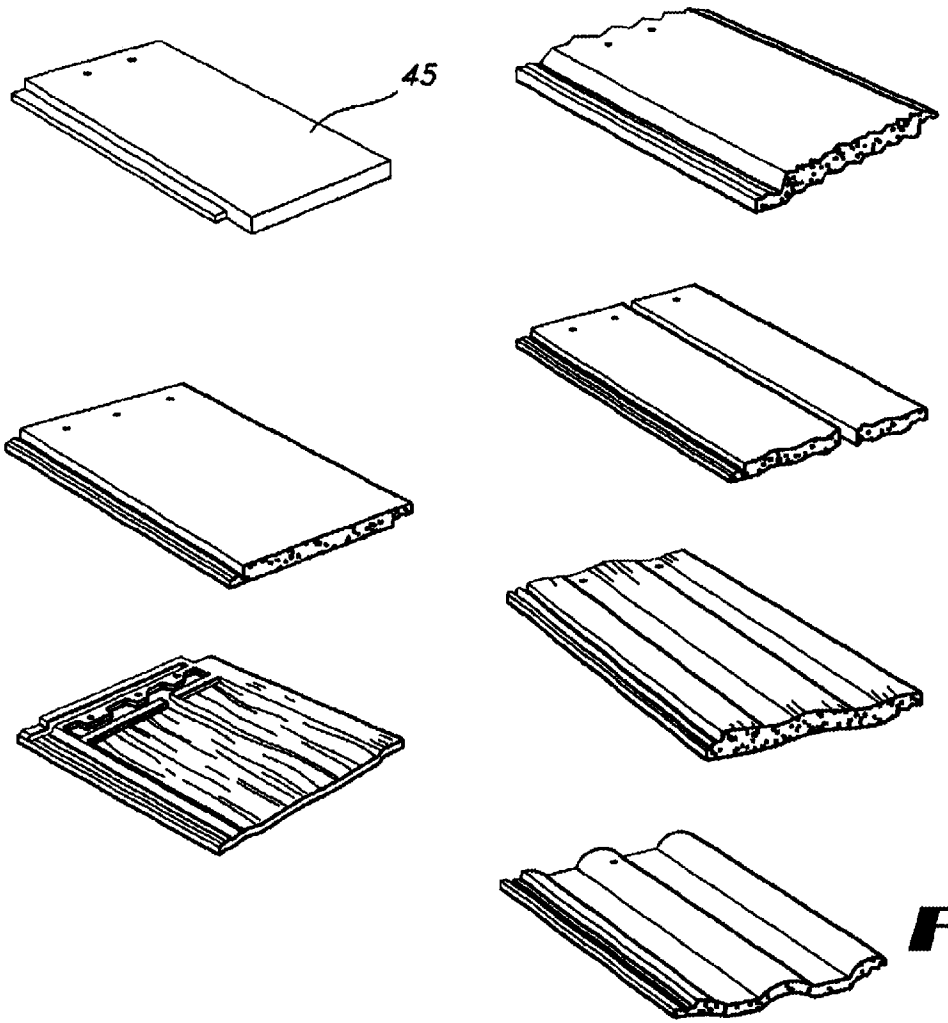
FIG. 15 is a perspective view of a variety of low-profile roof tiles.

Modern roof tiles are made in a wide variety of shapes and sizes to complement different architectural styles. A traditional Spanish-style roofing tile that is S-shaped in cross section is known in the industry as a high-profile tile 40. A variety of high-profile tiles 40 are shown in FIG. 14. Flat roofing tiles and shakes are known in the industry as low-profile tiles 45. A variety of low-profile tiles 45 are shown in FIG. 15.

When the first course of roof tiles is elevated to the desired angle or pitch along the eaves, a space is created between the eaves and the bottom profile of the tile. The several embodiments of the present invention provide closure of this space, drainage for the roof, and ventilation solutions for both high-profile and low-profile tiles.

A First Embodiment

Figure 1:
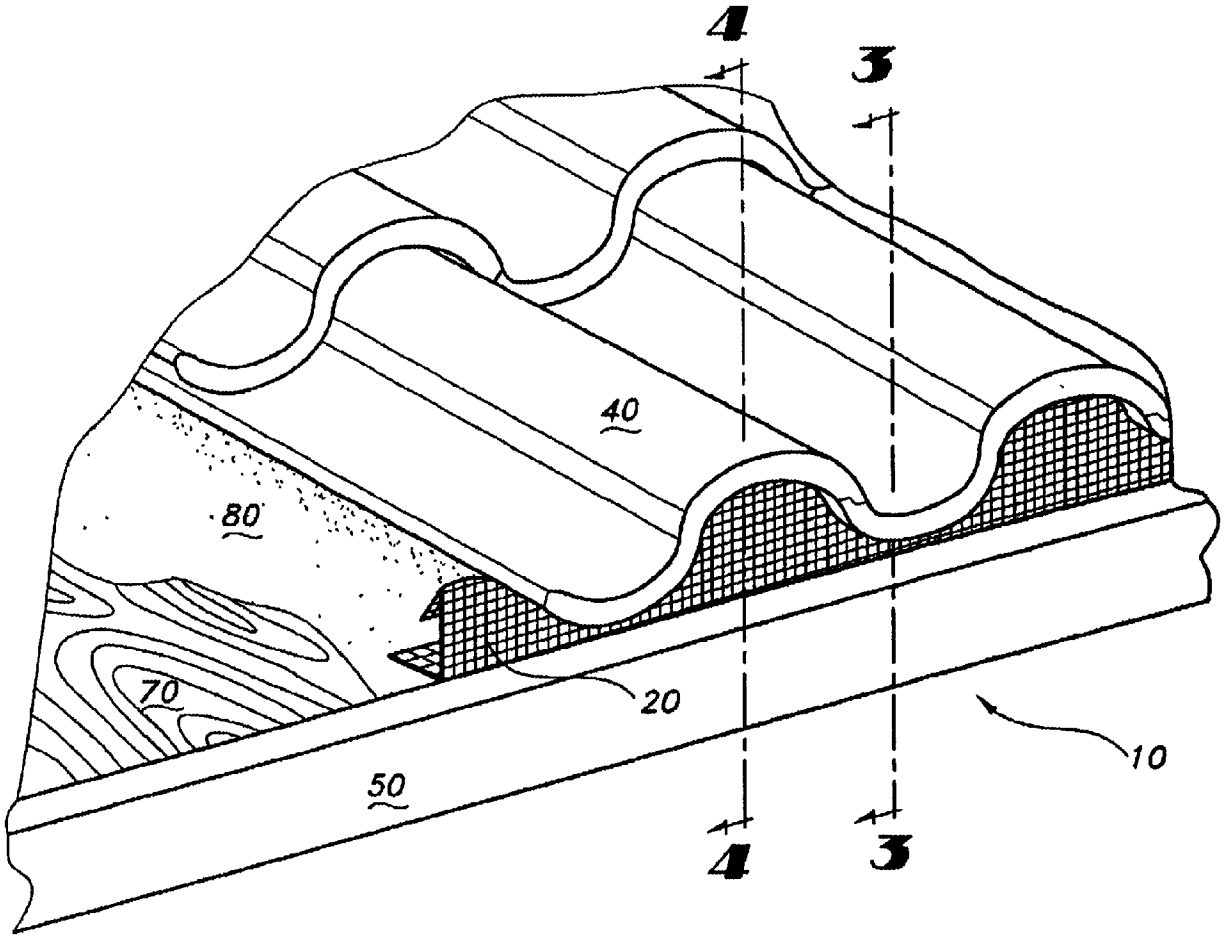
FIG. 1 is a perspective view of an eaves closure system according to a first embodiment of the present invention.

A first embodiment of the eaves closure system 10 of the present invention is shown in FIG. 1. A vented eaves closure 20 is supporting the first course of high-profile tiles 40 along the eaves 50 of a roof. The roof includes roof decking 70 and a waterproof underlayment 80.

Figure 2:
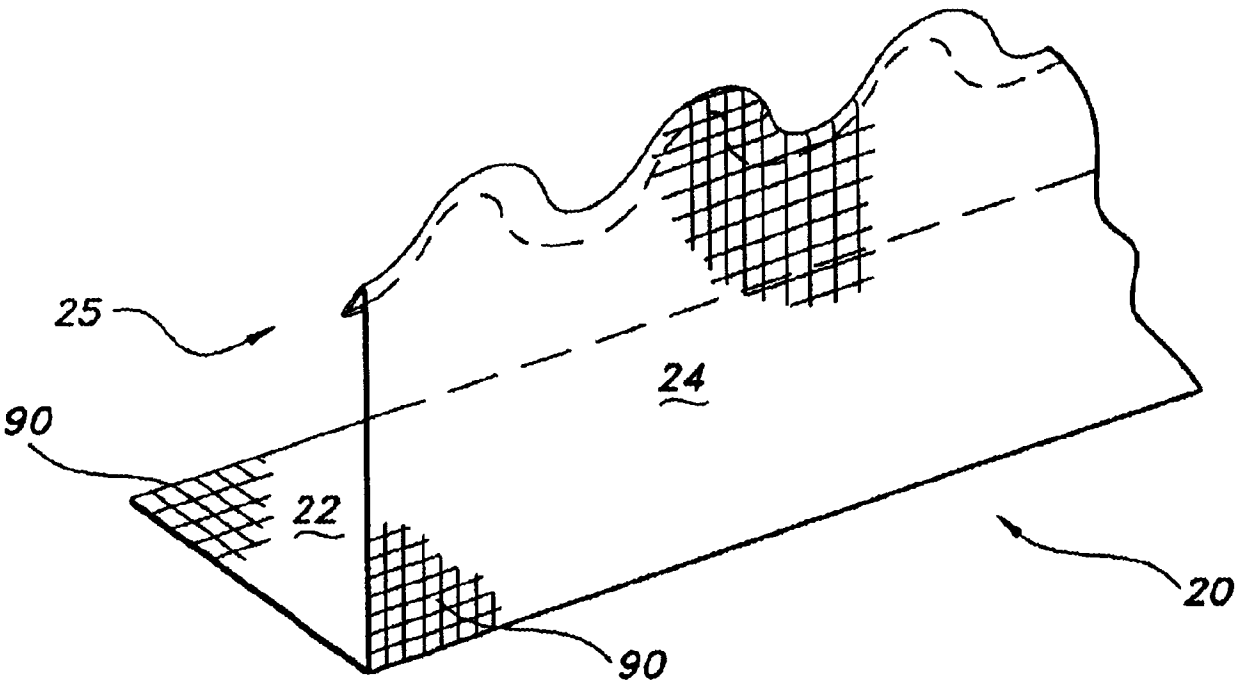
FIG. 2 is a perspective view of a vented eaves closure according to the first embodiment of the present invention.

FIG. 2 provides a more detailed perspective view of a vented eaves closure 20 according to the first embodiment. The vented eaves closure 20 includes a base 22 and a riser façade 24 disposed in planar contact with the base 22. The vented eaves closure 20 is preferably made from a single sheet of material having an array of openings 90. Preferably, the vented eaves closure 20 is made from a rigid or semi-rigid screen or meshed wire fabric to promote ventilation and allow drainage. The base 22 is placed generally parallel to the roof decking 70 and installed along the eaves 50 as shown in FIG. 1. The riser façade 24 extends vertically upward from the base 22 and has a sufficient height to support the first course of high-profile roof tiles 40 at a desired angle or pitch. The area of the riser façade 24 in contact with the bottom profile of the roof tile 40 is called the top edge of the riser façade 24.

The vented eaves closure 20 may also include a rim 25 along the top edge of the riser façade 24. The contour of the rim 25 matches the bottom profile of the tile 40 in order to provide closure to the eaves 50 beneath the tiles, thereby inhibiting weather infiltration and bird nesting and improving the appearance of the eaves 50. The rim 25 also adds strength and stability.

Generally, the base 22, the riser façade 24, and the rim 25 if provided, in one embodiment of the present invention, are rectangular sections or panels disposed at various relative angles and sized to provide support and closure along the eaves 50. The riser panel (24) is called the riser façade 24 because it is typically the most visible panel or face along the eaves 50. The riser façade 24 provides not only closure, but also a neat and finished appearance for the tile roof.

For embodiments where the top edge of the riser façade 24 is curved to match a high-profile tile 40, such as the one shown in FIG. 1, it may be necessary or advantageous to divide the rim 25 into segments by scoring or cutting the rim 25 at critical places along the top edge. When folded over, the segments of the rim 25 may overlap one another, particularly at places where the effective radius of the top edge is small. Alternatively, the material used to construct the vented eaves closure 20 and the rim 25 may be flexible enough to allow segments of the rim 25 to fold over one another without scoring or cutting the rim 25.

Figure 3:
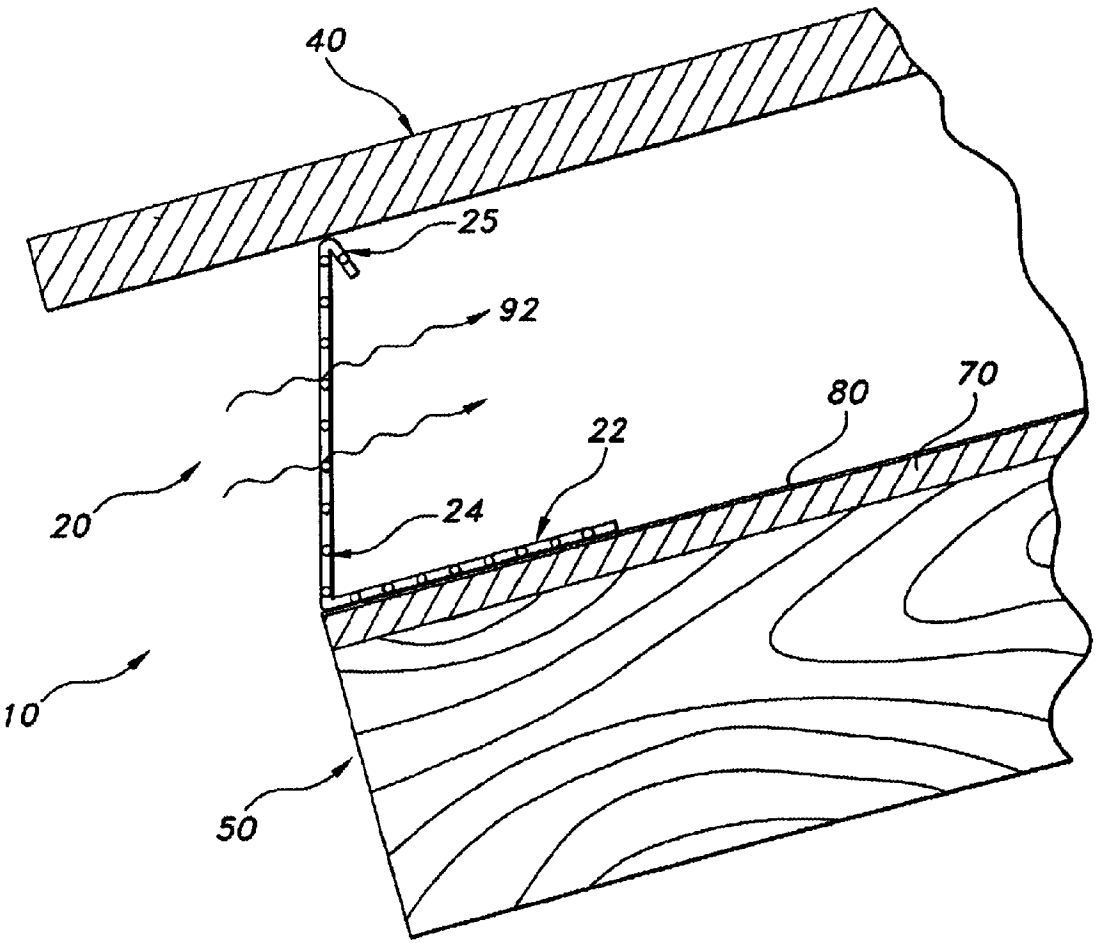
FIG. 3 is a sectional view of an eaves closure system taken along line 3—3 of FIG. 1, through the valley of a high-profile roof tile, according to the first embodiment of the present invention.

FIG. 3 shows section 3—3, which is taken through the lowest point or valley of one of the high-profile tiles 40 shown in FIG. 1. An airflow 92 passes through the array of openings 90 (not shown) in the vented eaves closure 20. For clarity, the vented eaves closure 20 appears solid when shown in cross section; however, it should be understood that the vented eaves closure 20 includes an array of openings 90 to permit drainage and facilitate ventilation. In cross section, the positioning of the base 22 relative to the roof decking 70 can be seen. In a typical application, the base 22 is fastened to the roof decking 70. The riser façade 24 rises vertically in this embodiment and not perpendicular to the roof decking 70. It should be noted, however, that placement of the riser façade 24 at other angles is contemplated in order to accommodate tiles of different types, shapes, and sizes. In other embodiments, for example, a riser façade 24 rising perpendicular to the roof decking 70 may be best suited to support the type of tile being installed. When the riser façade 24 is described as extending upwardly from the base 22, it should be understood that the plane of the riser façade 24 may form any angle with the roof decking 70 or base 22 that provides sufficient support for the roof tiles at the desired pitch.

The optional rim 25 as shown in FIG. 3 extends rearward from the top edge of the riser façade 24 and extends downward at an acute angle toward the base 22 of the vented eaves closure 20. This is not the only suitable configuration for a rim 25. In other embodiments, the rim 25 may extend forward, along the lower surface of the roof tiles 40. The rim 25 may also extend in a direction that is generally perpendicular to the riser façade 24. Other rim configurations are contemplated that will provide the strength and stability to the vented eaves closure 20.

In a typical application, the roof tiles 40 simply rest atop the top edge of the riser façade 24 of the vented eaves closure 20 without requiring an attachment. For certain applications, however, an attachment between one or more tiles and the vented eaves closure 20 may be preferred or required.

The vented eaves closure 20 may be made of any suitable material for the expected outdoor environment. Corrosion resistance, long life, and general durability are some of the features desired for such tile roof supports. In one embodiment, the vented eaves closure 20 is formed of galvanized aluminum or steel having a baked-on enamel coating. The vented eaves closure 20 may be made from a sheet of rigid screen or meshed wire fabric of sufficient strength to support the expected load of the roof tiles 40.

Figure 4:
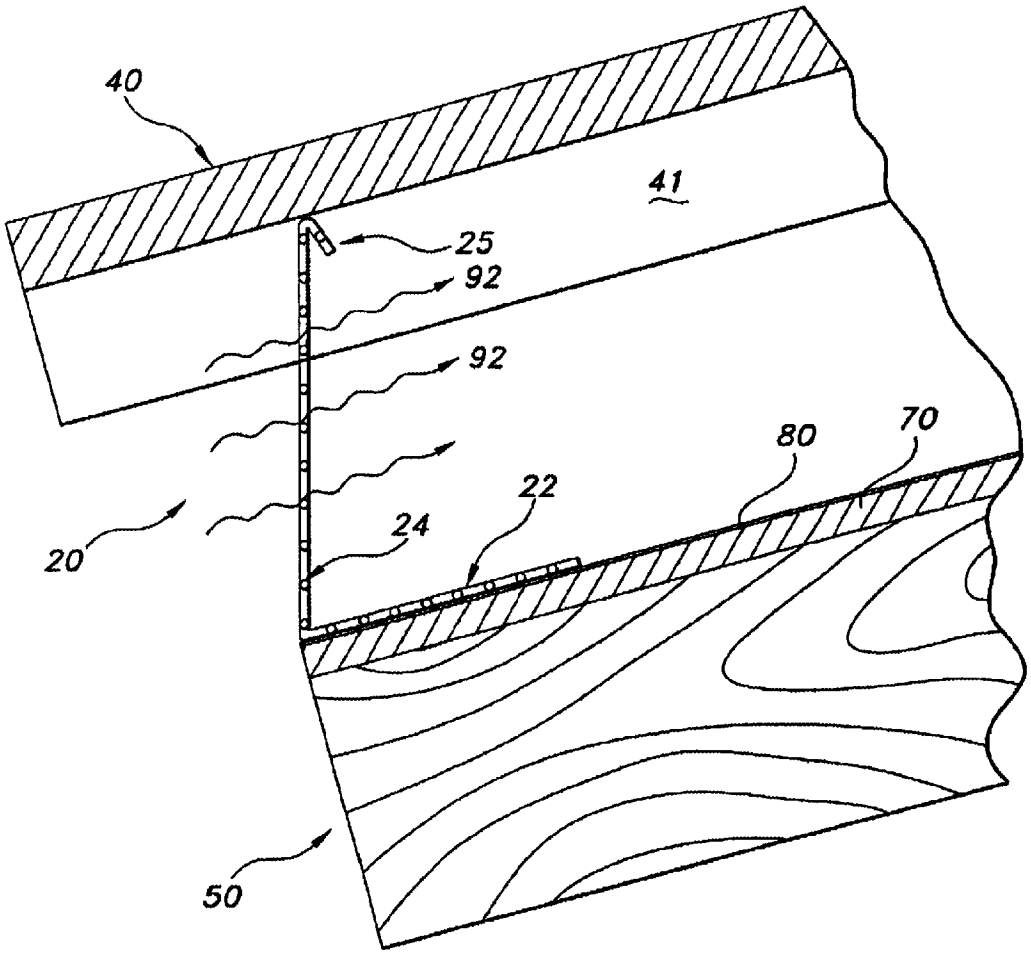
FIG. 4 is a sectional view of an eaves closure system taken along line 4—4 of FIG. 1, through the peak of a high-profile roof tile, according to the first embodiment of the present invention.

FIG. 4 shows section 4—4, which is taken through the highest point or peak of one of the high-profile tiles 40 in FIG. 1. An airflow 92 passes through the array of openings 90 (not shown) in the vented eaves closure 20. The riser façade 24 extends vertically upward from the roof decking 70 to the lower surface of the high-profile roof tiles 40. In this aspect, the vented eaves closure 20 provides complete closure to the arched spaces 41 beneath the roof tiles 40.

A Second Embodiment

Figure 5:
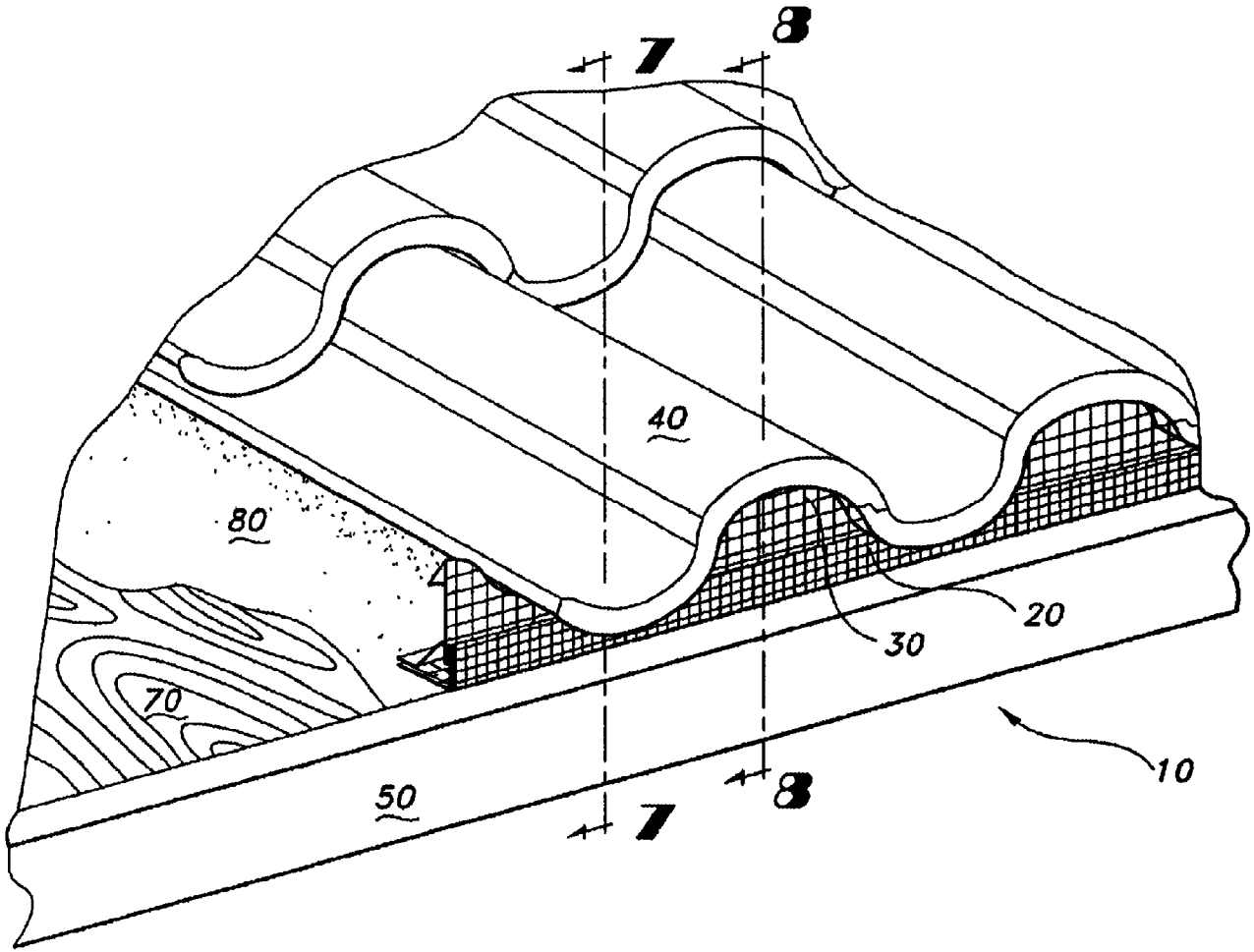
FIG. 5 is a perspective view of an eaves closure system according to a second embodiment of the present invention.

A second embodiment of the eaves closure system 10 of the present invention is shown in FIG. 5. In this embodiment, the eaves closure system 10 includes a vented eaves closure 20 and a vented profiled filler 30. The vented eaves closure 20, together with the vented profiled filler 30, supports the lower edge of the first course of roof tiles 40 and provides closure to the eaves 50.

In this embodiment, the vented eaves closure 20 has a uniform, standard shape that can be used to accept any of a variety of differently-contoured vented profiled fillers 30. As such, the vented eaves closure 20 shown in FIGS. 5 and 6 will have universal applicability among a wide variety of tile sizes and shapes. The vented eaves closure 20 will be suitable for use with any shape profiled filler 30. In fact, the vented eaves closure 20 may be used without a profiled filler 30 at all.

Figure 6:
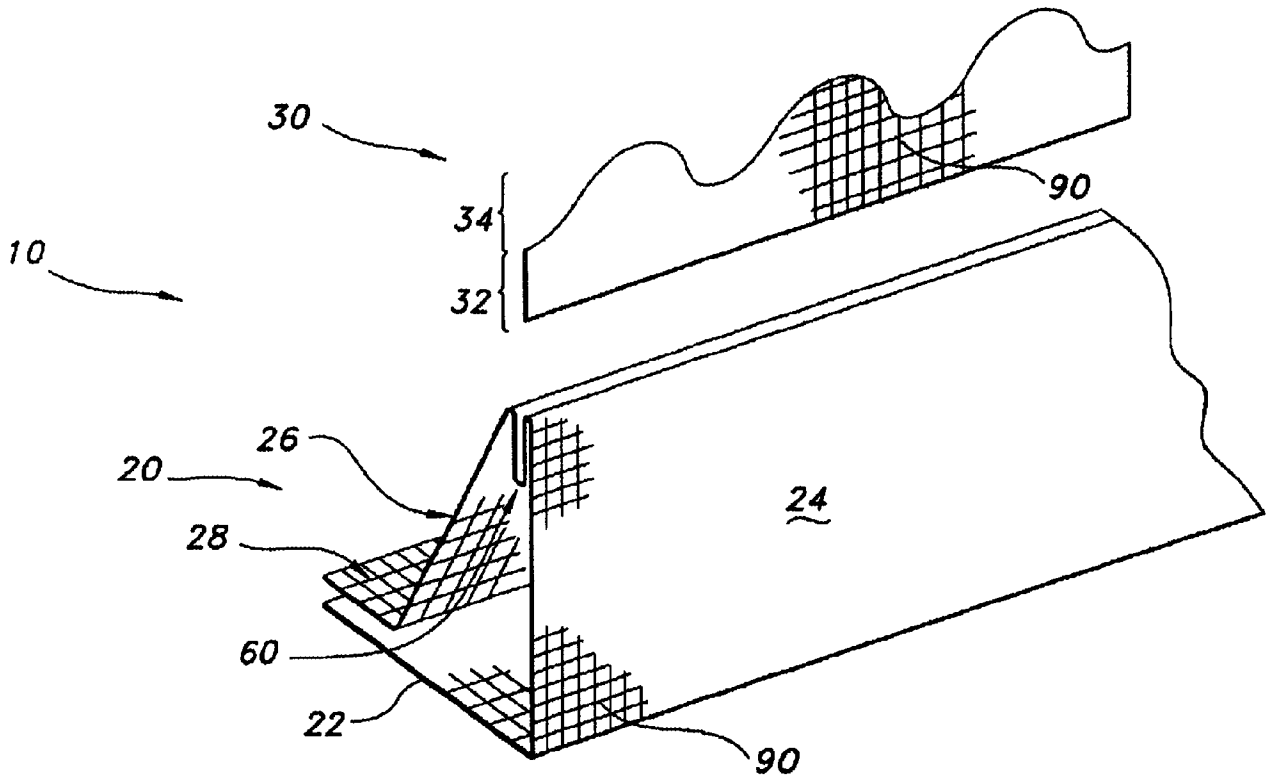
FIG. 6 is a perspective view of a vented eaves closure according to the second embodiment of the present invention.
Figure 12:
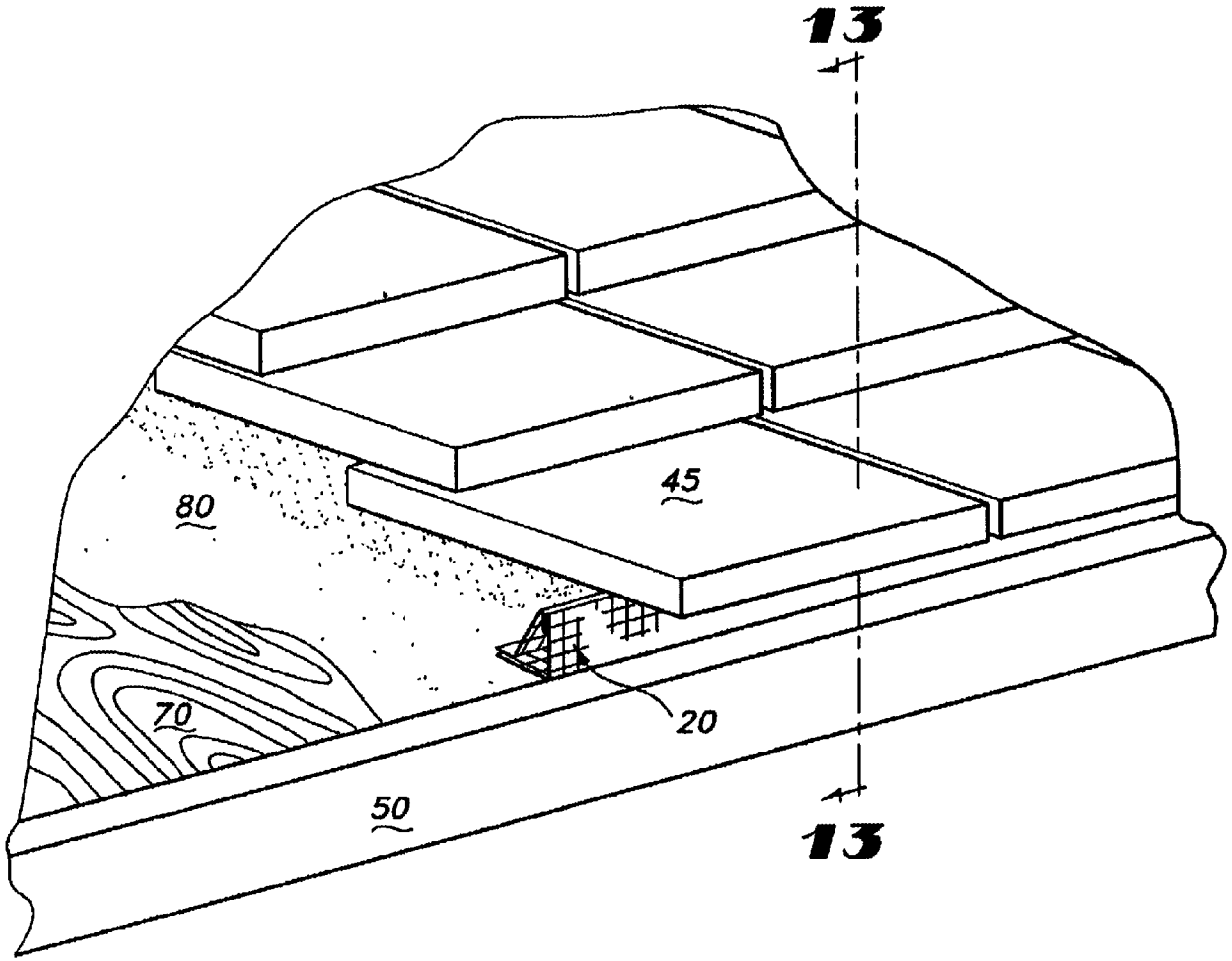
FIG. 12 is a perspective view of an eaves closure system according to a modification of a second embodiment of the present invention.
Figure 13:
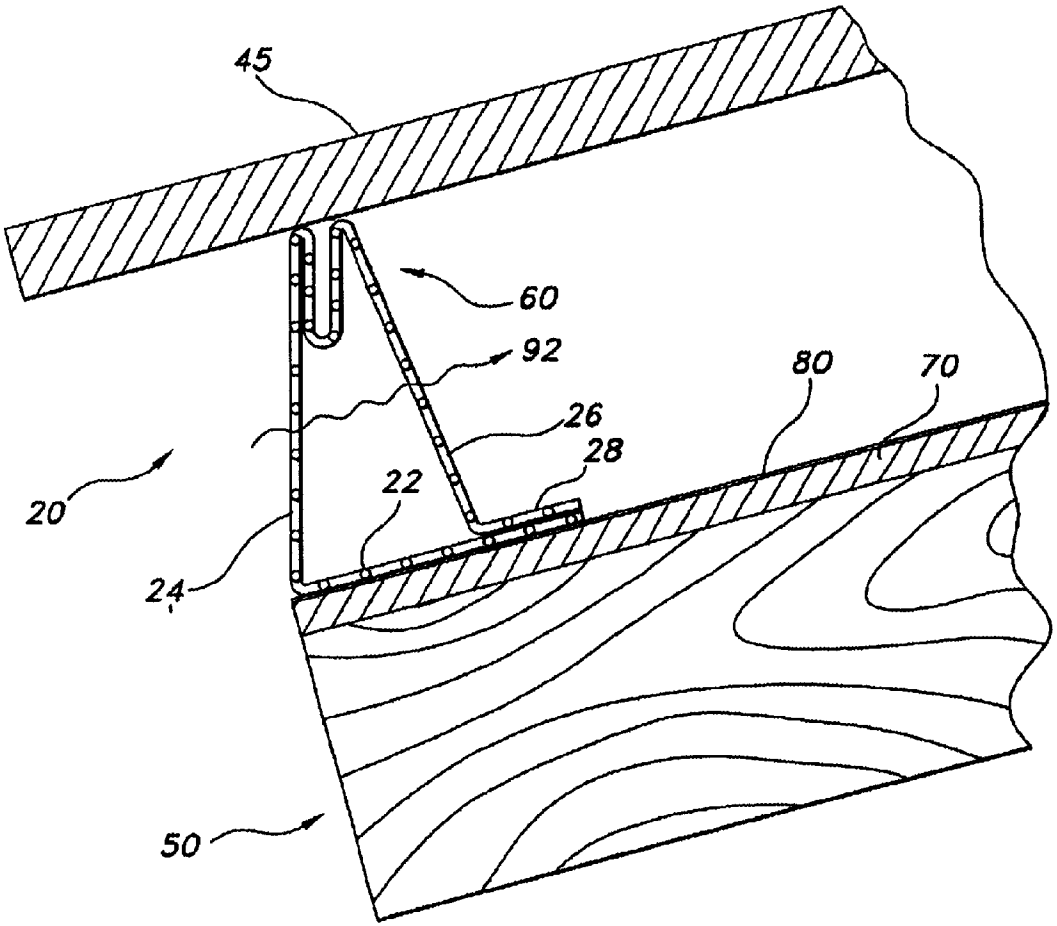
FIG. 13 is a sectional view of an eaves closure system taken along line 13—13 of FIG. 12.

FIG. 12 demonstrates the usefulness of the vented eaves closure 20 of the second embodiment for supporting the first course of substantially-flat, low-profile tiles 45 along the eaves 50. Although this second embodiment of the vented eaves closure 20 includes the top groove 60 and other structural features, it is used here without inserting a vented profiled filler 30. In certain applications, where a the low-profile tiles 45 are heavy or in climates where a heavy snow load may be expected, for example, the additional structural strength and stability of the second embodiment of the vented eaves closure 20 may be used, as shown in FIG. 12. FIG. 6 shows a perspective view of the second embodiment of the vented eaves closure 20, but for use with a low-profile tile 45 as shown in FIG. 12, the eaves closure system 10 does not include a vented profiled filler 30. FIG. 13 shows the vented eaves closure 20 in cross section, without a profiled filler 30.

FIG. 6 provides a closer, perspective view of the eaves closure system 10. The vented eaves closure 20 in this embodiment includes a base 22, a riser façade 24, a top groove 60, a rear riser 26, and a skirt 28. As shown, each of these components are disposed in planar contact with the adjacent component. The vented eaves closure 20 is preferably made from a single sheet of material having an array of openings 90. Preferably, the vented eaves closure 20 is made from a rigid screen or meshed wire fabric to promote ventilation and allow drainage.

The base 22 is placed generally parallel to the roof decking 70 and typically fastened to the roof decking 70 along the eaves 50. The riser façade 24 extends vertically upward from the base 22. The upwardly-directed top groove 60 is located along the top edge of the riser façade 24. The rear riser 26 extends rearward and down, at an acute angle, toward the base 22. The skirt 28 extends substantially parallel to the base 22. The base 22, the riser façade 24, and the rear riser 26 form the structural core of the vented eaves closure 20, which is generally triangular in cross section. The top groove 60 is positioned at the top of this generally-triangular core.

Figure 7:
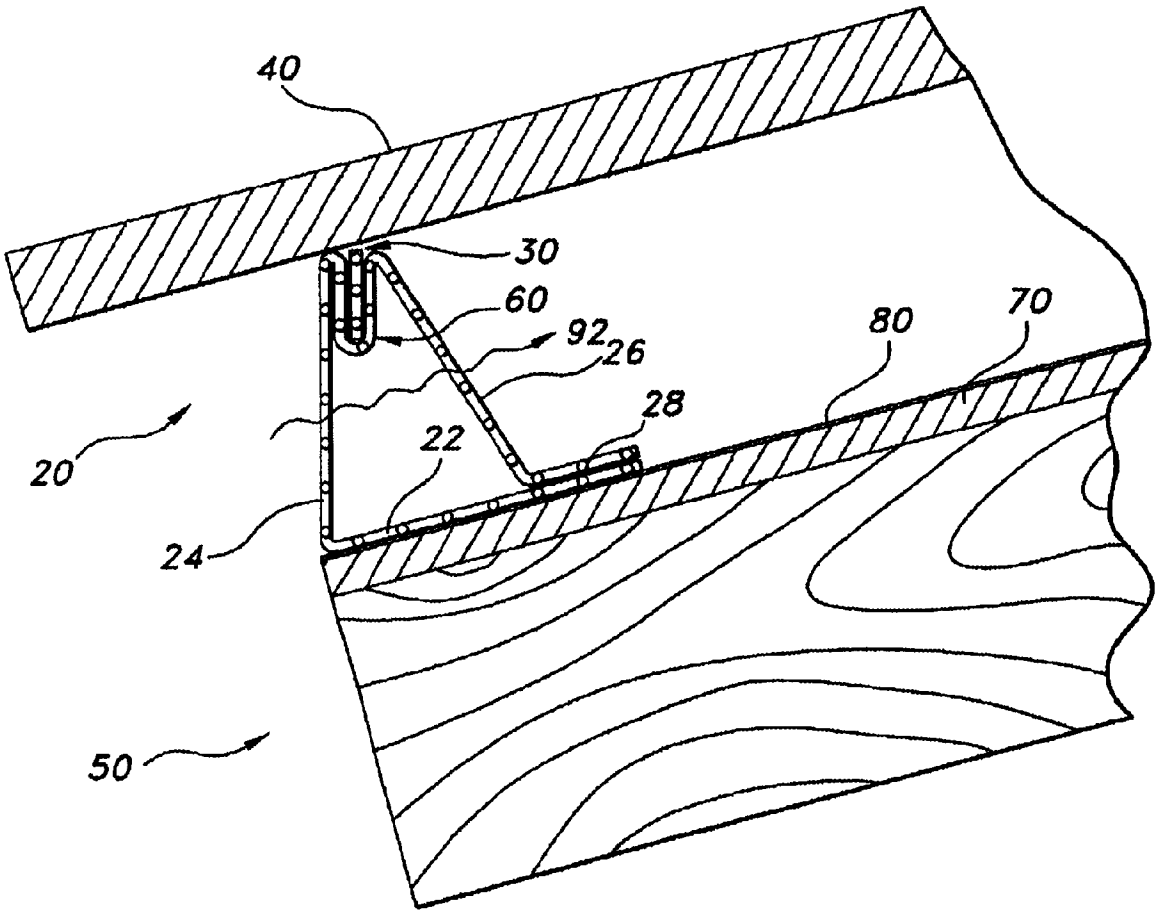
FIG. 7 is a sectional view of an eaves closure system taken along line 7—7 of FIG. 5, through the valley of a high-profile roof tile, according to the second embodiment of the present invention.

The top groove 60 forms a lengthwise, narrow channel having substantially parallel inner sides. The top groove 60 is supported from behind by a rear riser panel 26 which in one embodiment stands substantially perpendicular to the roof decking 70, as shown in FIG. 7. The skirt 28 extends nearly to the end of the base 22.

FIG. 6 shows the overall contour of the profiled filler 30 and its relation to the vented eaves closure 20. In another aspect of the invention, the vented profiled filler 30 may include a tongue area 32 and a profile area 34. In a preferred embodiment, the tongue area 32 is generally rectangular and sized to fit into the top groove 60 along the top edge of the vented eaves closure 20; preferably, without requiring a fastener. The profile area 34 is shaped to closely conform to the bottom profile or arched space 41 created by the curvature of a high-profile roof tile 40. In one preferred embodiment, the tongue area 32 and the profile area 34 are part of a single vented profiled filler 30 which is constructed of a single sheet of material that is permeable to air and water vapor, and fitted with an array of openings to facilitate ventilation.

The profiled filler 30 shown in FIG. 7 can be seen in its inserted position inside the top groove 60. Like the vented eaves closure 20, the profiled filler 30 is preferably made from a single sheet of material, such as a rigid or semi-rigid screen or meshed wire fabric, having an array of openings 90 (not shown) to promote ventilation and allow drainage.

Figure 8:
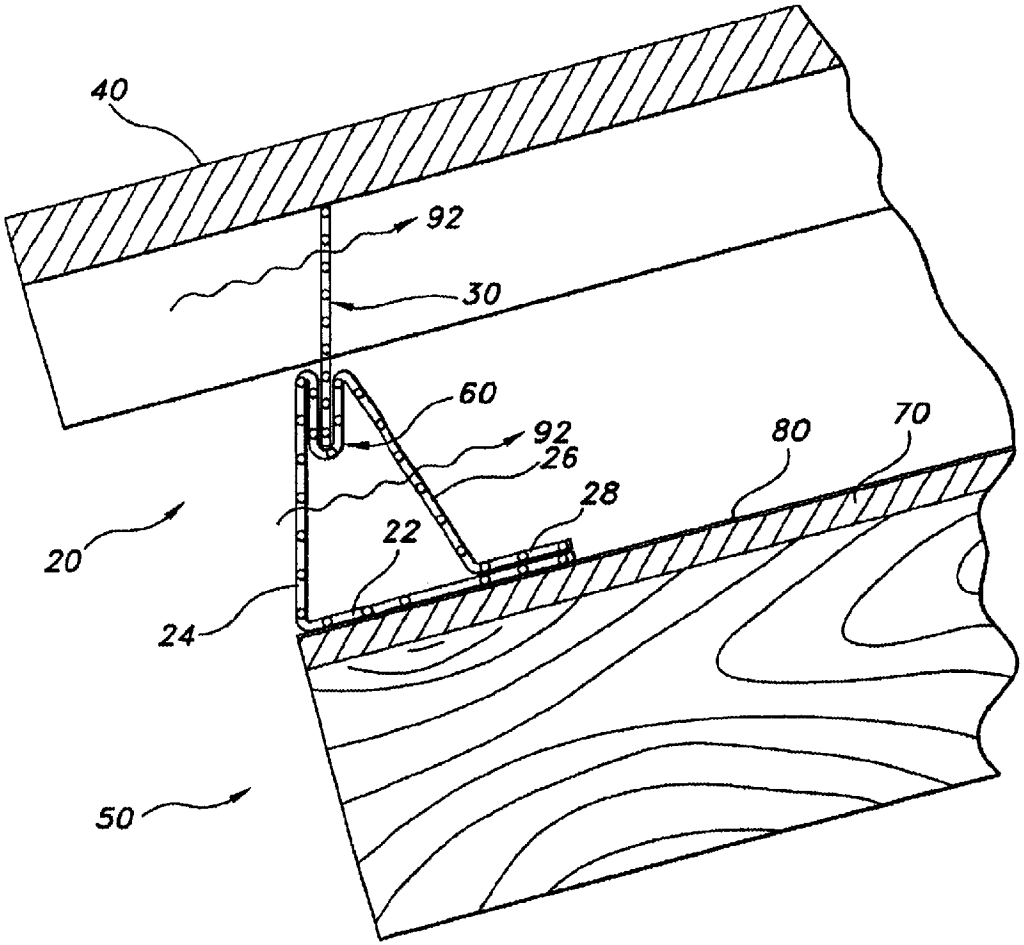
FIG. 8 is a sectional view of an eaves closure system taken along line 8—8 of FIG. 5, through the peak of a high-profile roof tile, according to the second embodiment of the present invention.

FIG. 8 shows section 8—8, which is taken through the peak of one of the high-profile tiles 40 in FIG. 5. An airflow 92 passes through the vented eaves closure 20 and the vented profiled filler 30. In this cross section, the profiled area 34 of the filler 30 can be seen extending vertically upward to the lower surface of the high-profile roof tiles 40. In this aspect, the profiled filler 30 provides complete closure to the arched spaces 41 beneath the roof tiles 40.

A Third Embodiment

Figure 9:
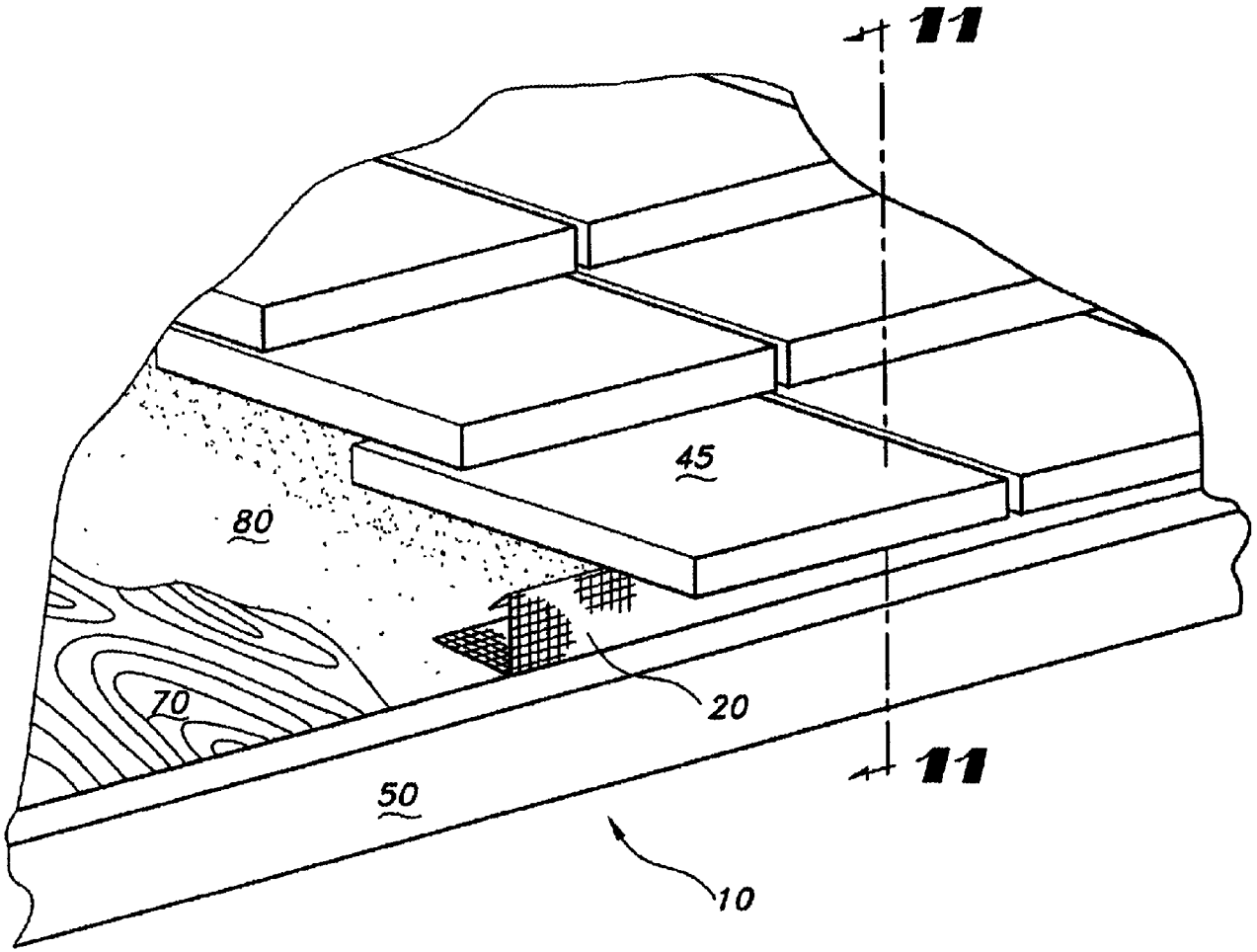
FIG. 9 is a perspective view of an eaves closure system according to a third embodiment of the present invention.

A third embodiment of the eaves closure system 10 of the present invention is shown in FIG. 9. A vented eaves closure 20 is supporting the first course of substantially-flat, low-profile tiles 45 along the eaves 50.

Figure 10:
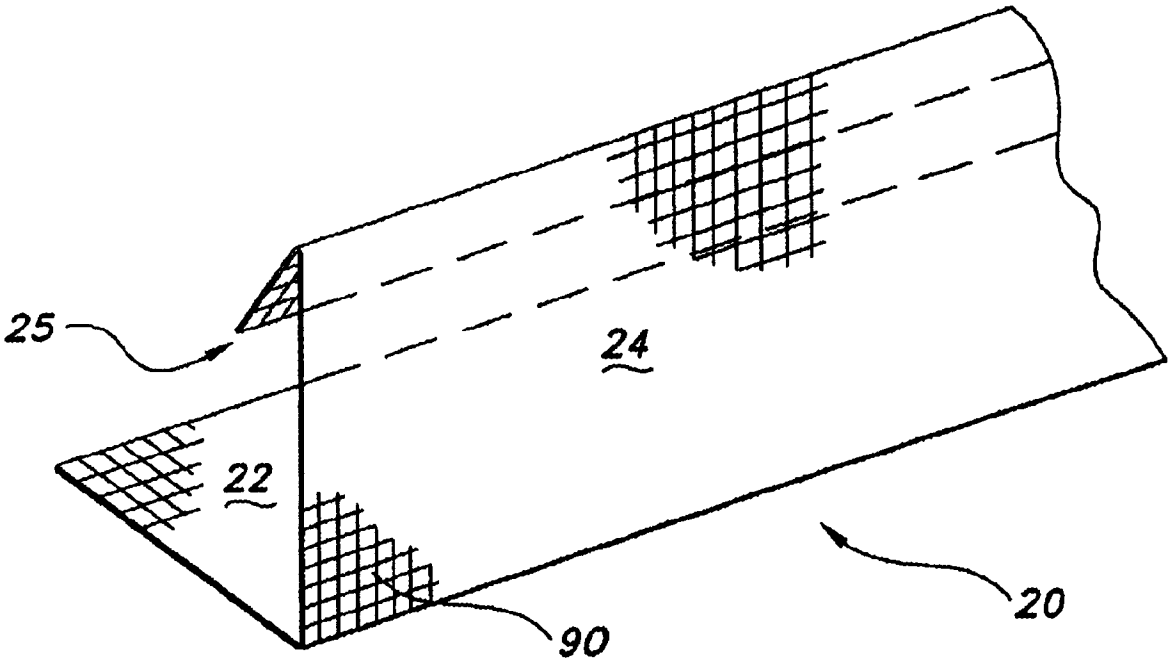
FIG. 10 is a perspective view of a vented eaves closure according to the third embodiment of the present invention.

FIG. 10 provides a more detailed perspective view of a vented eaves closure 20 according to the third embodiment. The vented eaves closure 20 includes a base 22, a riser façade 24 disposed in planar contact with the base 22, and may include a rim 25 along the top edge of the riser façade 24. The vented eaves closure 20 is preferably made from a single sheet of material having an array of openings 90. Preferably, the vented eaves closure 20 is made from a rigid screen or meshed wire fabric to promote ventilation and allow drainage. The riser façade 24 extends vertically upward from the base 22 and has a sufficient height to support the first course of high-profile roof tiles 40 at a desired angle or pitch. The generally straight edge of the rim 25 matches the substantially-flat profile of the low-profile tile 45 and provides closure to the eaves beneath the tiles.

Figure 11:
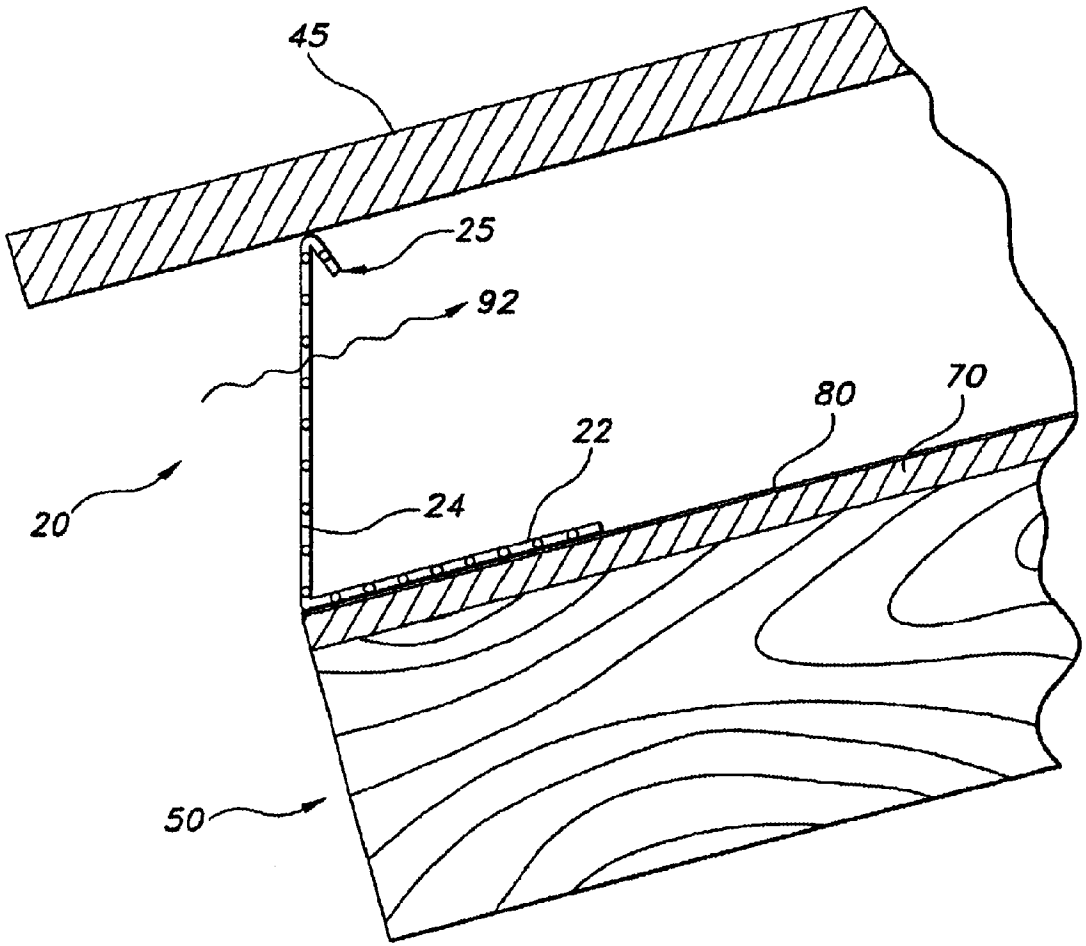
FIG. 11 is a sectional view of an eaves closure system taken along line 11—11 of FIG. 9, according to the third embodiment of the present invention.

FIG. 11 shows the vented eaves closure 20 in cross section. An airflow 92 passes through the array of openings 90 (not shown) in the vented eaves closure 20. In a typical application, the roof tiles 45 simply rest atop the top edge of the riser façade 24 of the vented eaves closure 20 without requiring an attachment. For certain applications, however, an attachment between one or more tiles and the vented eaves closure 20 may be preferred or required.

Materials

The material used for the vented eaves closure 20 and the vented profiled filler 30 may be permeable to air and water vapor. Openings 90 near the base of the closure 20 will allow water to drain freely off the roof decking 70. Other openings 90 in the closure 20 and the filler 30 will facilitate air ventilation.

The material used for the closure 20 and the filler 30 may be a galvanized metal, such as aluminum or steel, or it may be a rigid or semi-rigid plastic or any other material of sufficient strength to support the expected load of the roof tiles. In addition, the material should be corrosion resistant to corrosion. A metallic material, for example, may have a baked-on enamel coating.

The vented eaves closure 20 may be made economically from a single sheet of material. Preferably, the closure 20 may be made from a single sheet of semi-rigid screen or meshed wire fabric having an array of openings 90 to promote ventilation and allow drainage. Likewise, the vented profiled filler 30 is preferably made from a single sheet of material.

The array of openings in a meshed wire fabric is regular and repeating throughout the surface of the fabric. The woven wire forms and defines the openings. In addition to the obvious examples of screen or wire fabric, many other types of materials may contain an array of openings, in a regular and repeating pattern. For example, a solid vented eaves closure 20 may include an array of narrow slots through one edge of the riser façade 24, repeated in groups of ten every two inches, to form an array of openings in a repeating pattern. An array of openings in various patterns can be formed in almost any material.

The array of openings may be configured in any arrangement sufficient to provide drainage and promote ventilation. In one embodiment, only the riser façade 24 includes openings. In an embodiment where both a vented eaves closure 20 and a profiled filler 30 are provided, the array of openings may pass through both or, alternatively, through the eaves closure 20 only. Generally, the vented eaves closure 20 must include openings because it is positioned against the surface of the roof decking 70 and underlayment 80, across which draining water flows.

In another embodiment, where the drainage openings are arrayed separately from the ventilation openings, the drainage openings may pass through the vented eaves closure 20 only, or through both the eaves closure 20 and through the profiled filler 30. The ventilation openings may pass through both the eaves closure 20 and through the profiled filler 30 or, alternatively, through the profiled filler 30 only.

The terms rigid and semi-rigid do not mean completely inflexible. When a component is described as rigid, it should be understood that the component is generally supporting a weight that requires a certain degree of stiffness to be safe and durable. The substantially rigid screen or wire fabrics proposed for the vented eaves closure 20 or the vented profiled filler 30 may, in fact, be flexible enough to allow a desired amount of deformation and shaping when supporting the bottom profile of a roof tile that is not perfectly uniform.

In another embodiment, the vented eaves closure 20 or the vented profiled filler 30 may be extruded or otherwise formed as a continuous lengthwise member. For non-linear lengths of eaves, the closure 20 and the filler 30 may be sufficiently ductile to be bent in order to conform to different angles and shapes along the eaves 50. The closure 20 and the filler 30 may have finished and/or sealed ends, where appropriate, and they may have finished ends shaped to allow the joining of several closures 20 end-to-end (or several fillers 30 end-to-end).

Method of Fabrication

The vented eaves closure 20 may be fabricated economically by bending and shaping a single sheet of material according to a pattern. In one aspect of the invention, a plurality of standard or stock vented eaves closures 20 may be produced and stored for later use during installation of a certain type of tile. One method of installation a certain tile would include the step of selecting a vented eaves closure 20 from a group of stock closures 29 such as those shown in FIG. 17.

In another aspect of the invention, the vented eaves closure 20 selected for a particular installation may require additional shaping, in the field or by hand for example, until it fits the particular space between the eaves 50 and the bottom profile of the tile being installed. In a related aspect, the production of a plurality of vented eaves closures 20 having shapeless or blank riser façades 24 may be useful when shaping the closure 20 for installation with a unique tile shape required a custom fit.

Likewise, the vented profiled filler 30 may be fabricated economically by bending and shaping a single sheet of material according to a pattern. In one aspect of the invention, a plurality of standard or stock profiled fillers 30 may be produced and stockpiled for later use during installation of certain types of tile shapes. One method of installation a certain tile would include the step of selecting a vented profiled filler 30 from a group of stock fillers 39 such as those shown in FIG. 18.

In another aspect of the invention, the vented profiled filler 30 selected for a particular installation may require additional shaping, in the field or by hand for example, until it fits the particular space between the top edge of the riser façade 24 and the bottom profile of the tile being installed. In a related aspect, the production of a plurality of shapeless or blank vented profiled fillers 30 may be useful when installing a unique tile shape that requires a custom-fitted vented profiled filler 30.

Although many aspects of the present invention provide uniform and universal components and methods to improve the efficiency of a tile roof installation, the invention also encompasses a variety of options for custom-fitting and field shaping where desired.

Ventilation System

In another aspect, the present invention provides a ventilation system for a tile roof. In one embodiment, the roof tiles 40 are laid in such a manner atop the vented eaves closure 20 as to facilitate an airflow 92 beneath the roof tiles 40. The roof tiles 40 may be supported along the roof deck by a series of battens and counter-battens to create additional air space beneath the tile 40. The roof may include a ridge vent along the peak of the roof to further facilitate ventilation.

A cavity is formed between the roof decking, the roof tiles, the eaves, and the peak. The array of openings 90 through the eaves closure system 10 of the present invention promotes and facilitates air circulation within this cavity. In one embodiment, as shown in FIG. 8, an air mover 94 such as a fan can be added to actively draw air through the cavity. The air may be drawn in through the vented eaves closure system 10 and exhausted through a ridge vent.

Figure 16:
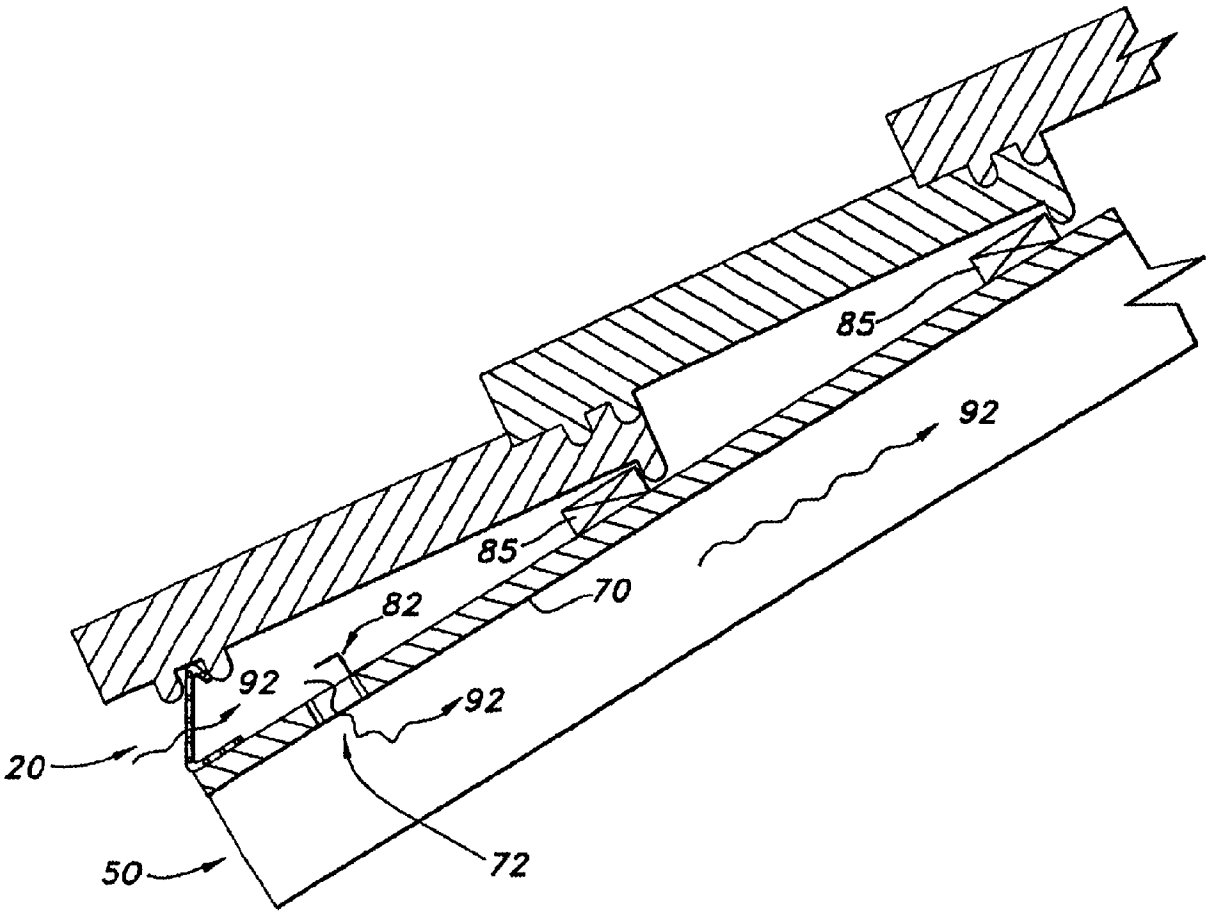
FIG. 16 is a sectional view of an eaves closure and roof ventilation system according to an embodiment of the present invention.

FIG. 16 shows a vented eaves closure 20 in use with a system for providing ventilation to the roof structure beneath the roof decking 70. FIG. 16 is a cross-sectional view of a roof structure that includes a series of vents 72 positioned between adjacent roof joists. Each vent 72 may include a flashing 82 to divert water away from the vent 72. The vents 72 in this embodiment are positioned between the eaves 50 and the first batten 85.

In this system, an airflow 92 passes through the array of openings 90 in the vented eaves closure 20 and is drawn into the vents 72, where the airflow 92 can ventilate the attic beneath the roof decking 70 and, in one embodiment, be drawn upward by convection forces or by a fan or air mover 94 such as the one shown in FIG. 16 and exhausted near the peak of the roof. In this aspect of the invention, the vented eaves closure 20 makes possible an improved system for ventilating an attic space.

It will be appreciated that the present invention provides a ventilated eaves closure system 10 to support the first course of roof tiles 40 along the eaves 50 of a roof at a desired pitch. Water sheds directly through the eaves closure system 10 from underneath the roof tiles 40 without any appreciable damming or ponding and without the insertion of any additional openings such as weep holes. Air circulates freely underneath the roof tiles 40 and throughout the eaves 50, attic, and roof structure 11, reducing the heat transfer into the attic space. The eaves closure system 10 blocks wind-driven precipitation, inhibits bird nesting, and prevents the invasion of animals through the eaves 50.

It will also be appreciated that the present invention provides a ventilated eaves closure apparatus 10 that is flexible and fits a variety of roof tiles 45, 40 having different sizes, and profiles.

Although the invention has been described in terms of a preferred embodiment, it will be appreciated by those skilled in the art that additions, substitutions, modifications, and deletions not specifically described may be made without departing from the spirit and scope of the invention as defined in the claims.

What is claimed is:

1. A tile roof ventilation system, comprising:

a plurality of partially overlapping roof tiles, each having a top surface and a bottom profile;

an eaves closure installed adjacent an eaves of a roof and having a base and a riser extending upwardly from said base to said bottom profile;

a cavity defined by a roof decking, said plurality of roof tiles, said eaves closure, and a roof peak; and an array of vents through said roof decking positioned at intervals to promote a circulation of air beneath said cavity, wherein said eaves closure is constructed of a material having a regular and repeating pattern of openings throughout, said openings sized and shaped to promote a circulation of air within said cavity.

2. An eaves closure system for use in conjunction with a roof having an eaves, said eaves closure system comprising:

a vented eaves closure comprising a base adjacent an eaves of a roof and a riser façade extending upwardly from said base to an upper edge;

a vented profiled filler comprising a tongue area configured to connect to said vented eaves closure and a profiled area sized and shaped to support a first course of roof tiles at a desired pitch and to fill a space defined by said upper edge and said first course of roof tiles; and an array of openings to permit drainage and promote ventilation through said eaves closure system.

3. The eaves closure system of claim 2, wherein said vented eaves closure further comprises a groove along said upper edge sized and shaped to receive said tongue area.

4. The caves closure system of claim 2, wherein said profiled area further comprises a rim disposed along a top edge of said profiled area.

5. The caves closure system of claim 2, wherein said vented eaves closure further comprises a rear riser extending from said upper edge toward said base.

6. The eaves closure system of claim 5, wherein said vented eaves closure further comprises a skirt extending from said rear riser in a direction generally parallel to said base.

7. The caves closure system of claim 2, wherein said array of openings pass through said vented eaves closure only.

8. The eaves closure system of claim 2, wherein said vented profiled filler is constructed of a solid material.

9. The eaves closure system of claim 2, wherein said vented eaves closure is constructed of a material having a regular and repeating pattern of openings therethrough.

10. The eaves closure system of claim 2, wherein said vented profiled filler is constructed of a material having a regular and repeating pattern of openings therethrough.

11. A method for providing ventilation and closure to a tile roof, said method comprising:

providing a vented eaves closure having a base, a riser façade extending upwardly from said base to an upper edge, and an array of openings to permit drainage and promote ventilation through said vented eaves closure;

providing a vented profiled filler sized and shaped to support a first course of roof tiles at a desired pitch and to fill a space defined by said upper edge and said first course of roof tiles;

attaching said base to a roof decking adjacent an eaves of a roof;

connecting said vented profiled filler to said vented eaves closure, and laying said first coarse of roof tiles atop said vented eaves closure.

12. The method of claim 11, wherein said vented profiled filler is constructed of a solid material.

13. The method of claim 11, further comprising:

constructing said vented eaves closure of a material having a regular and repeating pattern of openings therethrough.

14. The method of claim 11, further comprising:

constructing said vented profiled filler of a material having a regular and repeating pattern of openings therethrough.

15. The method of claim 11, wherein said step of connecting said vented profiled filler to said vented eaves closure comprises:

providing a groove along said upper edge sized and shaped to receive a portion of said vented profiled filler; and inserting vented profiled filler into said groove.

16. The method of claim 11, further comprising:

shaping said vented profiled filler until its size and shape will fill a space defined by said upper edge and said bottom profile.

17. The method of claim 11, further comprising:

selecting said vented profiled filler from a plurality of stock fillers having a blank profile; and shaping said blank profile until the size and shape of said vented profiled filler will fill a space defined by said upper edge and said bottom profile.

* * * * *

UNITED STATES PATENT AND TRADEMARK OFFICE

CERTIFICATE OF CORRECTION

PATENT NO. : 6,941,706 B2
APPLICATION NO. : 10/143566
DATED : September 13, 2005
INVENTOR(S) : Austin et al.

It is certified that error appears in the above-identified patent and that said Letters Patent is hereby corrected as shown below:

Column 12,

Lines 62 and 65, “caves” should read --eaves--.

Column 13,

Line 5, “caves” should read --eaves--;

Line 30, “coarse” should read --course--.

Signed and Sealed this

Second Day of December, 2008

JON W. DUDAS
*Director of the United States Patent and Trademark Office*